US009301570B2

(12) United States Patent
Hwang

(10) Patent No.: US 9,301,570 B2
(45) Date of Patent: Apr. 5, 2016

(54) SHOE WITH ELASTICITY

(76) Inventor: Bo Yeoun Hwang, Chang-si (KR)

( * ) Notice: Subject to any disclaimer, the term of this patent is extended or adjusted under 35 U.S.C. 154(b) by 1191 days.

(21) Appl. No.: 12/376,622

(22) PCT Filed: Jan. 26, 2007

(86) PCT No.: PCT/KR2007/000474

§ 371 (c)(1),
(2), (4) Date: Apr. 15, 2010

(87) PCT Pub. No.: WO2008/018666

PCT Pub. Date: Feb. 14, 2008

(65) Prior Publication Data

US 2010/0199522 A1 Aug. 12, 2010

(30) Foreign Application Priority Data

Aug. 10, 2006 (KR) ..... 10-2006-0075720

(51) Int. Cl.

| | |
|---|---|
| ***A43C 11/00*** | (2006.01) |
| ***A43B 3/26*** | (2006.01) |
| ***A43B 1/00*** | (2006.01) |
| ***A43C 11/14*** | (2006.01) |
| ***A43B 23/04*** | (2006.01) |

(52) U.S. Cl.

CPC ..... *A43B 3/26* (2013.01); *A43B 1/0054* (2013.01); *A43B 1/0081* (2013.01); *A43B 23/047* (2013.01); *A43C 11/002* (2013.01); *A43C 11/1493* (2013.01)

(58) Field of Classification Search

CPC ..... A43B 1/0081; A43B 23/047; A43B 3/26; A43C 11/1493; A43C 11/002

USPC ..... 36/105, 51, 50.1, 138, 97, 112, 68

See application file for complete search history.

(56) References Cited

U.S. PATENT DOCUMENTS

| | | | | | |
|---|---|---|---|---|---|
| 118,929 | A | * | 9/1871 | Hall | 36/51 |
| 1,211,127 | A | * | 1/1917 | Fox | 36/51 |
| 1,465,343 | A | * | 8/1923 | Case | 36/51 |
| 1,687,915 | A | * | 10/1928 | Williams | 36/50.1 |

(Continued)

FOREIGN PATENT DOCUMENTS

| | | | |
|---|---|---|---|
| JP | 2001-346601 | A | 12/2001 |
| KR | 20-1985-0008298 | U | 11/1985 |
| KR | 20-1988-0002879 | Y1 | 8/1988 |

(Continued)

*Primary Examiner* — Ted Kavanaugh

(74) *Attorney, Agent, or Firm* — Arent Fox LLP

(57) ABSTRACT

Disclosed is a shoe with elasticity, which can be easily and conveniently put on and taken off a user's food and can always maintain the original shape thereof. The shoe with elasticity, comprising a sole serving as a bottom of a shoe, an upper combined with edges of the sole for covering a top and sides of a user's foot when a user wears the shoe, an elastic member coupled to the counter of the upper for covering the heel of the user's foot, a support, extending backward from the counter of the upper of the shoe and combined with a lower end portion of the elastic member, for supporting the heel of a user, and a fixing member having a first end fixed to one side of the upper and a second end detachably attached to the other side of the upper, for surrounding the exterior of the elastic member and fixing the user's foot in the shoe. Accordingly, a user can easily put on and take off the shoe with elasticity according to the present invention, so that weak and old people and handicapped people can comfortably walk when wearing the shoe.

5 Claims, 2 Drawing Sheets

(56) References Cited

U.S. PATENT DOCUMENTS

| | | | | |
|---|---|---|---|---|
| 1,818,594 | A * | 8/1931 | Williams | 36/50.1 |
| 2,592,182 | A * | 4/1952 | Perugia | 36/51 |
| 6,189,239 | B1 * | 2/2001 | Gasparovic et al. | 36/102 |
| 7,685,747 | B1 * | 3/2010 | Gasparovic et al. | 36/102 |
| 2010/0011621 | A1 * | 1/2010 | Malka-Harari | 36/97 |

FOREIGN PATENT DOCUMENTS

| | | | |
|---|---|---|---|
| KR | 20-1990-0018141 | U | 11/1990 |
| KR | 20-1991-0000088 | U | 1/1991 |

* cited by examiner

SHOE WITH ELASTICITY

TECHNICAL FIELD

The present invention relates to a shoe with elasticity, and more particularly to a shoe with elasticity in which an elastic member is provided to the counter of the upper of the shoe and a fixing member surrounds the elastic member and fixes the counter of the shoe, so that the shoe can be easily put on even by old and weak people or users who have difficulty in moving themselves, such as corpulent people, handicapped people or patients, so that the users can walk comfortably because the shoe is fixed to a user's foot once the user has put on the shoe.

BACKGROUND ART

Generally, a shoe comprises a sole, serving as the bottom of a shoe, and an upper, covering the top and sides of a user's foot. When a user puts on a shoe, the user typically first puts his or her toes through a hole in the upper of the shoe and then puts the rest of his or her foot into the shoe. At this time, the heal of the user's foot is first placed on an upper portion of a rear part of the upper of the shoe, and then the user pulls backward the rear part of the upper of the shoe so that the user's foot can easily slip into the shoe if the size of the shoe fits the user's foot. In order to conduct such a motion to put on the shoe, the user must bend over and put a shoehorn or a finger in between the counter of the shoe and the heel of the user's foot.

The weak, the old, and users who have difficulty moving encounter difficulty putting on their shoes through the above-described motions.

For example, in the case in which the users are children, since shoes for children are relatively small in comparison with shoes for adults even though they have the same shape as shoes for adults, the elasticity of the upper of shoes for children, which is made of leather or artificial leather, is less than that of shoes for adults. Accordingly, such shoes are difficult for children to wear. Further, in the case in which the users are old people, since old people have difficulty squatting and leaning forward, it is hard for old people to conduct such motions. Such problems are also encountered by corpulent people, handicapped people, and patients.

In order to solve the above-described problem, an improved shoe is disclosed in Korean Utility Model No. 95-5408. The improved shoe has elastic members disposed in the middle portions of left and right sides, respectively, of the upper of a shoe, in order to help a user easily put on the shoe. However, the improved shoe described in Korean Utility Model No. 95-5408 has a disadvantageous effect in that the elastic members can be easily damaged by physical shocks and corrosive chemicals because the elastic members are made of a material which has relatively poor durability in comparison with the upper of the shoe.

In order to solve the advantageous effect encountered in the above-described shoe, a shoe with a dual upper has been developed and a patent application therefor has been filed and assigned Korean Patent Application No. 2005-124252. As shown in FIG. 1, the upper of the shoe is structured in a manner such that an internal upper 10 of the shoe has cuts 11 at the left and right sides thereof, band members 12 are provided at the cuts 11, and the internal upper is surrounded by an external upper 30. That is, since the external upper covers the internal upper, the durability of the shoe is improved. However, this type of shoe also has problems. That is, since it is difficult to manufacture the dual upper of the shoe in an automatic production line, the upper of the shoe must be manufactured by hand. Accordingly, productivity thereof is very low. Further, the external upper of the shoe is usually wide, and a seam in the counter of the upper of the shoe is not tidy, so that the shoe does not have a good appearance. Still further, when fixing the external upper 30 to the internal upper 10, or separating the external upper 30 from the internal upper 10, the left side and the right side of the upper must be worked on separately to prepare therefor, which is troublesome.

DISCLOSURE OF INVENTION

Technical Problem

In order to solve the above problems, it is an object of the present invention to provide a shoe with elasticity, which can be easily worn by a user who has difficulty moving, such as an old or handicapped person, and which has good durability. Further, it is a further object of the present invention to provide a shoe with elasticity that can be easily manufactured at high productivity.

Technical Solution

In order to achieve the above objects and advantageous effects, according to one aspect of the present invention, there is provided a shoe with elasticity comprising a sole serving as the bottom of a shoe; an upper, combined with edges of the sole and covering the top and sides of a user's foot, an elastic member provided at the counter of the upper of the shoe to cover the heel of a user's foot, a support extending backward from the counter portion of the upper of the shoe and connected to a lower end portion of the elastic member to support the heel of a user, and a fixing member having a first end fixed to one side of the upper and a second end detachably attached to the other side of the upper to surround the exterior of the elastic member, thereby fixing a user's foot.

The support is preferably connected to a rear end portion of the elastic member, and has a middle portion extending upward from the rear end portion of the elastic member.

The fixing member preferably comprises a hook-and-loop fastener (VELCRO®)-type, a magnet-type, or a pressure button-type in which buttons are combined by pressure.

The fixing member preferably has the first end thereof fixed to one side of the upper and the second end passing by the elastic member, passing through a ring provided on one side of the upper, and extending toward the first end fixed to the upper.

Advantageous Effects

As described above, the shoe according to the present invention has an advantageous effect in that a user can feel comfortable even in the case in which the user is a child whose foot rapidly grows or the user is wearing a thick sock or more than one sock on the foot in the shoe, because the shoe can elastically expand by about 5 to 9 millimeters due to the structure in which the elastic member is provided at the counter of the upper of a shoe and a fixing member for surrounding the elastic member is attached to the upper of the shoe. Further, since the length of the shoe is somewhat increased, a user can easily put on the shoe because a user's foot can be easily inserted into the shoe and the user feels comfortable because the foot is fixed by the fixing member when the user wears the shoe.

Still further, since the support is provided to the elastic member, the shape of the shoe can be maintained even when the elastic member is not extended.

DETAILED DESCRIPTION OF KEY ELEMENTS OF THE DRAWINGS

100: Sole 200: Upper part

210: Support 300: Elastic member

400: Fixing member 500: hook-and-loop fastener (VELCRO®)

BEST MODE FOR CARRYING OUT THE INVENTION

Hereinafter, the present invention will be described in detail with reference to the accompanying drawings.

<First Embodiment>

Figure 1:
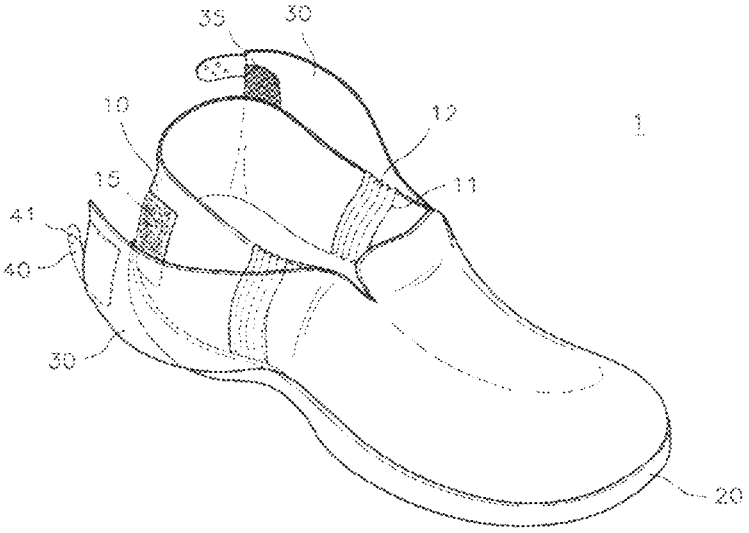
FIG. 1 is a perspective view illustrating a shoe having a dual upper according to the conventional art.
Figure 2:
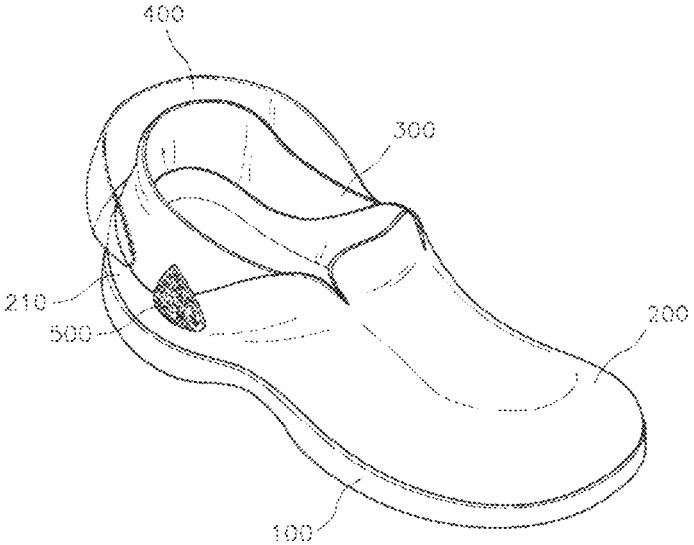
FIG. 2 is a perspective view illustrating a shoe with elasticity according to a first embodiment of the present invention.

FIG. 2 is a perspective view illustrating a shoe with elasticity according to a first embodiment of the present invention.

As shown in FIG. 2, the shoe according to the first embodiment of the present invention comprises a sole 100, an upper 200, an elastic member 300, a support 210 and a fixing member 400.

The sole 100 serves as the bottom of a shoe. The sole of the shoe is a typical sole used in conventional shoes. Accordingly, a detailed description of the sole will be omitted.

The upper 200 of the shoe may be made of leather, artificial leather or synthetic resin, and is combined with the edges of the sole 100, thereby covering the sides and the top of a foot.

The elastic member 300 is combined with a rear portion, which is the counter portion, of the upper 200, thereby covering the heel of the foot when a user wears the shoe. The elastic member 300 is made of rubber or synthetic cloth having elastic restoring force and extends in the longitudinal direction of the shoe.

Figure 3:
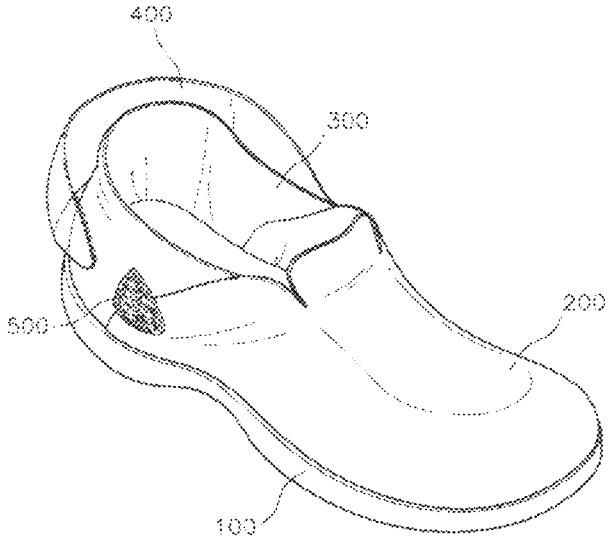
FIG. 3 is a perspective view illustrating a shoe having an elastic member but lacking a support, according to a modified example of the first embodiment of the present invention.

The support 210 is combined at a lower portion of the elastic member for supporting the elastic member and a user's foot. The support 210 is provided to help the shoe maintain a proper form thereof because the shoe cannot maintain the form of a shoe if the shoe has only the elastic member 300, such as rubber, without the support 210, as shown in FIG. 3, due to the low strength of the elastic member 300. That is, since the support, having relatively low elasticity, is disposed at a lower portion of the elastic member, the elastic member can maintain a predetermined shape.

According to the first embodiment of the present invention, the support 210 is installed to extend from an end portion of the upper 200 to a lower portion of the elastic member 300. Accordingly, the support 210 has relatively high strength in comparison with the elastic member 300, which is made of an elastic material, so that it helps the elastic member 300 maintain its original shape. According to the first embodiment, the support 210 and the upper of the shoe are integrated, but they can be prepared in separate pieces and then combined to each other later.

Next, the fixing member 400 will be described. The fixing member 400 has a first end fixed to one side of the upper 200 of the shoe and a second end passing by the counter of the shoe and extending to the other side of the upper 200. The second end is provided with a hook-and-loop fastener (VELCRO®) tape so that the second end of the fixing member 400 is detachably attached to the other side of the upper 200 of the shoe. The hook-and-loop (VELCRO®) tape 500 can be substituted with a magnet or a pressure-button. The fixing member 400 supports a rear portion of a foot when a user wears the shoe, so that it prevents the foot from sliding backward, which can occur when the elastic member is stretched backward.

Figure 4:
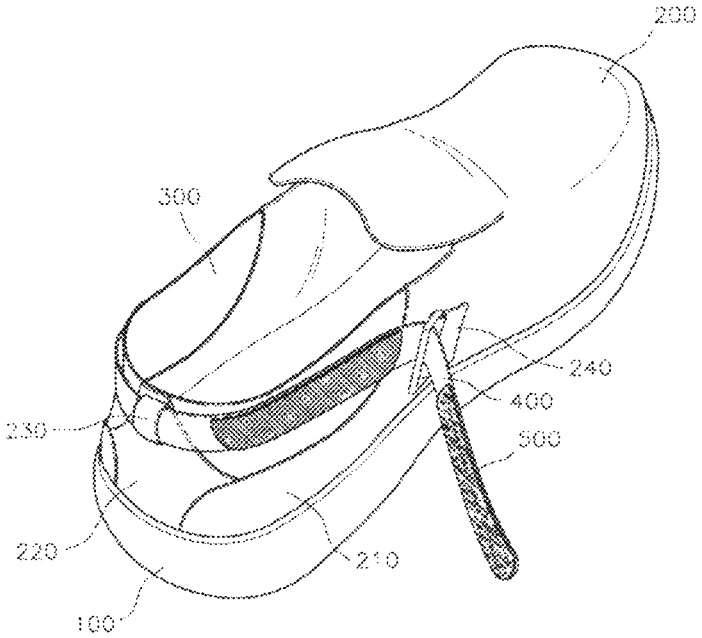
FIG. 4 is a perspective view illustrating a shoe with elasticity according to a second embodiment of the present invention.

Here, the fixing member 400 is not limited to the structure in which the first end is fixed to one side of the upper 200 of the shoe, and the second end is detachably attached to the other side of the upper 200. As shown in FIG. 4, the first end of the fixing member 400 is fixed to one side of the upper 200 of the shoe, but the second end of the fixing member 400 passes through a ring provided to the other side of the upper 200 of the shoe and is then detachably attached to a portion of the fixing member 400. According to the structure shown in FIG. 4, the length of the fixing member 400 can be adjusted according to the size of a wearer's foot. In this case, since the length of the fixing member is increased, a fixing ring 230 may be additionally needed. The fixing ring 230 is fixed to the counter of the shoe for fixing the middle portion of the fixing member 400.

Advantageous effects of the shoe with elasticity according to the first embodiment will be described below. When a user tries to put on the shoe, the user detaches the second end, that is, the hook-and-loop fastener (VELCRO®) tape 500, of the fixing member 400 from the upper so that the elastic member 300 can be extended backward freely, puts his or her foot, starting with the toes, into the shoe, pulls the fixing member 400 to tighten the fixing member 400 to fit the heel of the user's foot, and then attaches the hook-and-loop fastener (VELCRO®) tape 500 to the upper 200 of the shoe. Accordingly, weak or old people and people who cannot freely move can easily put on the shoe.

<Second Embodiment>

In the shoe, according to the second embodiment of the present invention, as shown in FIG. 4, a middle portion of the support 210 is extended upward and combined with an upper portion of the elastic member 300. Here, instead of extending the support 210, a piece of material which is the same as the upper 200 of the shoe is additionally provided and attached to the elastic member to substitute for the extending portion of the support 210. That is, attaching the piece of material which has low elasticity, for example, the upper of the shoe, to the middle portion of the elastic member 300, the shoe can maintain the shape of the shoe well. Further, it is possible to minimize damage to the elastic member when a user wears the shoe using a shoehorn.

INDUSTRIAL APPLICABILITY

As described above, since the fixing member prevents the elastic member from being damaged by covering the elastic member, the shoe with elasticity according to the present invention has long durability. That is, the shoe has a long lifespan, so that a user's expenditure on shoes is reduced.

Further, since the support is installed on the elastic member, the shape of the shoe is maintained, so that the merchantability of the shoe is high.

Still further, since the shoe has a simple structure in which the elastic member is fixed to the counter of the upper of the shoe, the shoe can be manufactured in an automatic production line. As a result, the shoe can be manufactured at high productivity and can reduce manufacturing costs.

The invention claimed is:

1. A shoe with elasticity, comprising:

a sole, serving as a bottom of a shoe;

an upper, combined with edges of the sole for covering a top and sides of a user's foot when a user wears the shoe;

an elastic member, coupled to a counter of the upper for covering a heel of the user's foot;

a support combined with a lower end portion of the elastic member, for supporting the heel of a user; and a fixing member having a first end comprising a first border, and a second end comprising a second border, wherein the first border is opposite to the second border, and wherein the first end is fixed to one side of the upper at the first border and the second end is detachably attached to the other side of the upper, for surrounding an exterior of the elastic member and fixing the user's foot in the shoe, and wherein the second end passes by the elastic member and then through a ring provided to the other side of the upper of the shoe and extends toward the first end.

2. The shoe with elasticity according to claim 1, wherein the support has a middle portion combined with a rear portion of the elastic member.

3. The shoe with elasticity according to claim 1, wherein the fixing member comprises an end portion comprising a hook-and-loop fastener, a magnet, or a pressure button.

4. The shoe with elasticity according to claim 1, wherein the elastic member comprises a rubber or synthetic cloth having elastic restoring force and extending in the longitudinal direction of the shoe.

5. The shoe with elasticity according to claim 1, wherein the shoe comprises an additional piece of material attached to a middle portion of the elastic member.

* * * * *